US008641437B2

(12) United States Patent
Tu et al.

(10) Patent No.: US 8,641,437 B2
(45) Date of Patent: Feb. 4, 2014

(54) TULIP CONTACT AND ELECTRICAL CONTACT SYSTEM FOR SWITCHING DEVICE

(75) Inventors: Zhanwei Tu, Fujian (CN); Kuikui Zhu, Guangdong (CN); Yurong Lv, Fujian (CN)

(73) Assignee: ABB Technology Ltd., Zurich (CH)

( * ) Notice: Subject to any disclaimer, the term of this patent is extended or adjusted under 35 U.S.C. 154(b) by 0 days.

(21) Appl. No.: 13/384,430

(22) PCT Filed: Aug. 12, 2009

(86) PCT No.: PCT/CN2009/073212

§ 371 (c)(1), (2), (4) Date: Jan. 17, 2012

(87) PCT Pub. No.: WO2011/017838

PCT Pub. Date: Feb. 17, 2011

(65) Prior Publication Data

US 2012/0129374 A1 May 24, 2012

(51) Int. Cl.
*H01R 13/64* (2006.01)
*H01R 13/642* (2006.01)

(52) U.S. Cl.
USPC ..... 439/251; 439/826

(58) Field of Classification Search
USPC ..... 439/251, 821, 252, 826
See application file for complete search history.

(56) References Cited

U.S. PATENT DOCUMENTS 2,300,893 A * 11/1942 Hayford ..... 439/821
2,331,255 A * 10/1943 West ..... 439/251
4,072,392 A * 2/1978 McConnell et al. ..... 439/851
4,427,858 A 1/1984 Fehr et al.
4,841,108 A 6/1989 Hamm
6,024,611 A * 2/2000 Giuseppe ..... 439/819
6,139,347 A * 10/2000 Nebon et al. ..... 439/251

(Continued)

FOREIGN PATENT DOCUMENTS

| | | | |
|---|---|---|---|
| CN | 1183624 | A | 6/1998 |
| CN | 101128896 | A | 2/2002 |
| CN | 201336245 | Y | 10/2009 |
| DE | DD229831 | A1 | 11/1985 |
| JP | 2002334637 | A | 11/2001 |

OTHER PUBLICATIONS

ISA/CN, International Search Report re Application No. PCT/CN2009/073212, May 20, 2010.

*Primary Examiner* — James Harvey

(74) *Attorney, Agent, or Firm* — Anthony M. Del Zoppo, III; Driggs, Hogg, Daugherty & Del Zoppo Co., LPA

(57) ABSTRACT

A tulip contact comprises a plurality of outer contact fingers and inner contact fingers. The outer contact fingers forming a shape of the outer surface of fixed contact in order to make the contact surface of each of these fingers contact with the outer surface of fixed contact. The inner contact fingers forming a shape of the inner surface of fixed contact in order to make the contact surface of each of these fingers contact with the inner surface of fixed contact. Each said contact finger comprises a first contact bulge for contacting with the surfaces of the fixed contact, and a second contact bulge for contacting with the bushing. And each said contact bulge comprises a contact slot on its surface. The first contact bulges of the outer contact fingers are not at the same cross section with the first contact bulges of the inner contact fingers.

13 Claims, 6 Drawing Sheets

(56) References Cited

U.S. PATENT DOCUMENTS

| | | | | |
|---|---|---|---|---|
| 8,038,466 | B1 * | 10/2011 | Tai et al. | 439/485 |
| 8,070,502 | B2 * | 12/2011 | Mitter et al. | 439/252 |
| 8,226,428 | B2 * | 7/2012 | Arnaud et al. | 439/252 |
| 8,269,127 | B2 * | 9/2012 | Seo | 218/123 |
| 2007/0246444 | A1 * | 10/2007 | Saxl et al. | 218/16 |
| 2010/0140225 | A1 * | 6/2010 | Seo | 218/140 |
| 2012/0129374 | A1 * | 5/2012 | Tu et al. | 439/312 |

* cited by examiner

TULIP CONTACT AND ELECTRICAL CONTACT SYSTEM FOR SWITCHING DEVICE

RELATED APPLICATION

This application is a national filing of PCT application Serial No. PCT/CN2009/073212, filed Aug. 12, 2009.

FIELD OF THE INVENTION

This invention relates generally to the field of power products and power system, and more particularly to a contact mechanism and electrical contact system for switching device.

BACKGROUND OF THE INVENTION

Tulip contact is generally used in middle and/or high voltage switching devices. The contact fingers are essentially intended for rated electrical current disconnection operation and current transmission by providing a contact finger-trap which is connected to a mating contact.

U.S. Pat. No. 4,072,392A discloses a spring wire formed tulip contact which comprises cylindrical male contact 11 and female members 12, as shown in FIG. 1A. The female member 12 is formed by placing a number of spring wire fingers 13 around the outer circumference of a cylindrical stud member 14 in such a manner that the fingers 13 extend axially outward from the stud 14 to form a female contact sleeve 15. Each of the fingers 13 is bent axially inward with respect to the stud 14 in order that the internal diameter of the female contact sleeve 15 is shorter than the external diameter of the cylindrical male contact 11. The fingers 13 can electrically and mechanically contact with the cylindrical male contact 11. This tulip contact employs inexpensive spring wire which is readily available and free from defects. And the individual wire fingers may be formed into the desired shape by using a one-step automated form and cut-off machine. But this tulip contact does not have a large effective contact area.

EP0856860B1 discloses a tulip contact for a high voltage switching devices, as shown in FIG. 1B. The tulip contact 16 is designed to hold a mating contact 17 in the form of a pin, with contact fingers 18 arranged in a circular shape. A cylinder 19 is provided axially with slots being integrally formed on a circular ring 20. A ring is integrally formed on the end of the cylinder 19 opposite to the circular ring and its cross-sectional shape, together with the cylinder 19, is in the form of a golf club. The free axial end of the ring has a radial annular surface 21 on which a section 17 made of erosion resistant material is mounted. The internal diameter of the tulip contact 16 corresponding to the mating contact is shorter than the internal diameter of the section 17 made of erosion resistant material. This tulip contact has the disadvantage that its structure is not very firm.

US20070246444A1 discloses an electrical contact system for a switching device, as shown in FIG. 1C. The system has a contact 23 including a tulip-shaped contact unit, which is provided on a fixed plate 25. The plate 25 is connected to an axle tube 26 which is made of copper. The contact unit has contact fingers 24 with inner and outer surfaces. The surfaces fit into a counter contact 27 when a switching device is in a closed operating condition to form contacting surfaces for supplying current to the contact 27. The inner and outer surfaces of the contact fingers reduce the number of contact fingers 24, and improve the alignment tolerances. The fixed plate on which the tulip-shaped contact unit is provided is connected with the axle tube, thus reducing the contact transition resistance from the tulip-shaped contact unit to the axle tube.

In addition to above mentioned shortcomings of the traditional tulip contacts, all these tulip contacts do not possess such most important qualities as high electric conductivity, low heat generation and high heat ventilation.

SUMMARY OF THE INVENTION

To overcome above shortcomings, the main purpose of the present invention is to provide a tulip contact and electrical contact system with tulip contact for switching device which possess qualities such as better conductivity, lower heat generation, better heat ventilation, stronger structure and higher reliability. The tulip contact and electrical contact system of the present invention can withstand high electrical current. Furthermore, it is easy to install.

According to one aspect of the invention, a tulip contact for switching device is provided. The tulip contact comprises a plurality of contact fingers and these contact fingers fall into outer contact fingers and inner contact fingers. The cross-section formed by said plurality of outer contact fingers is complimentary to the cross-section of the outer surface of fixed contact, so that the contact surface of each of these contact fingers can contact the outer surface of fixed contact; and the cross-section formed by said plurality of inner contact fingers is complimentary to the cross-section of the inner surface of fixed contact, so that the contact surface of each of these contact fingers can contact the inner surface of fixed contact.

According to the preferred embodiment of the present invention, each said contact finger comprises a first contact bulge for contacting with the inner surface or the outer surface of the fixed contact, and a second contact bulge for contacting with the bushing.

According to the preferred embodiment of the present invention, each of the contact bulges comprises a contact slot on its surface. The contact slot is to make the contact fingers contact with the fixed contact or the bushing more tightly.

According to the preferred embodiment of the present invention, each of the contact fingers comprises a groove and a holding block. The tulip contact further comprises a spring and a disk. Said spring fixes the contact fingers on said disk.

According to another preferred embodiment of the present invention, one end of the leaf spring is embedded in the grooves of each of the contact fingers and that for the outer contact fingers, the other end of leaf springs pushes the outer contact fingers on the disk axially inward; and that for the inner contact fingers, the other end of leaf springs pushes the inner contact finger on the disk axially outward.

According to a preferred embodiment of the present invention, a ring spring is embedded in the grooves of the outer contact fingers and encircles them; and a second ring spring is embedded in the grooves of the inner contact fingers and encircles them.

According to a preferred embodiment, the imaginary plain on which the plurality of first contact bulges of the outer contact fingers are located do not overlap with the imaginary plain on which the first contact bulges of the inner contact fingers are located.

According to the other aspect of the invention, an electrical contact system for switching device is provided. The electrical contact system comprises a fixed contact and a tulip contact as described above which is arranged to contact with said fixed contact.

According to the preferred embodiment, said fixed contact comprises a plurality of openings for ventilation.

According to the preferred embodiment, the end of said fixed contact that contacts with the tulip contact has a radial annular surface.

According to a preferred embodiment, the electrical contact system further comprises a bushing and a ring nut. The ring nut is to fix the disk and all contact fingers on the bushing.

BRIEF DESCRIPTION OF THE DRAWINGS

The subject matter of the invention will be explained in more details in the following description with reference to preferred exemplary embodiments which are illustrated in the drawings, in which:

FIG. 1 is a schematic view of the conventional tulip contacts; in which

FIG. 2 shows the structure of the tulip contact according to one preferred embodiment of the present invention; in which

FIG. 4 is a schematic view of a contact finger of the tulip contact; in which

FIG. 5 is an enlargement view of the contact slot on the contact fingers; in which

DETAILED DESCRIPTION OF PREFERRED EMBODIMENTS

With reference to the above-mentioned figures, preferred embodiments of the present invention are provided.

Figure 1A:
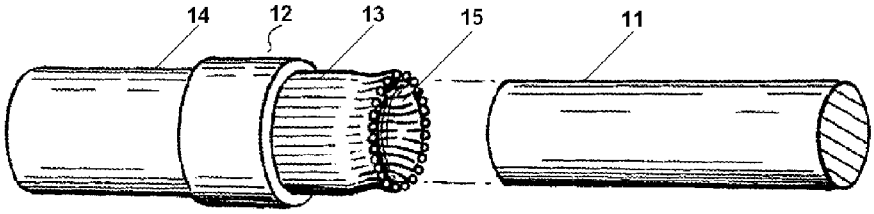
PRIOR ART Fig. 1A
FIG. 1A shows the structure of a spring wire formed tulip contact.
Figure 1B:
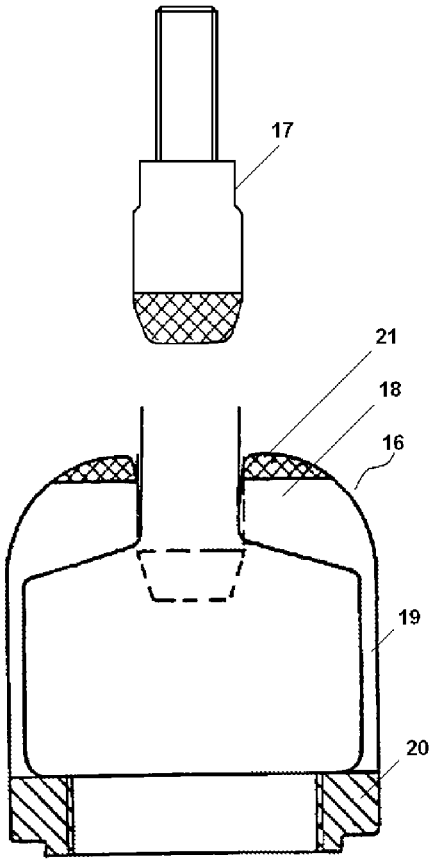
PRIOR ART Fig. 1B
FIG. 1B shows the structure of a tulip contact with outer contact fingers.
Figure 1C:
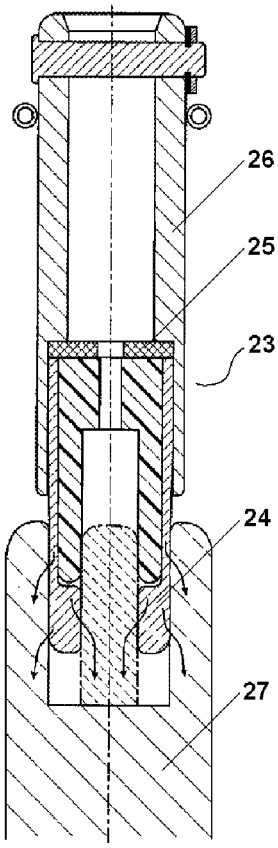
PRIOR ART Fig. 1C
FIG. 1C shows a contact system for an electrical switching device with a contact of tulip-in-tulip design.
Figure 2A:
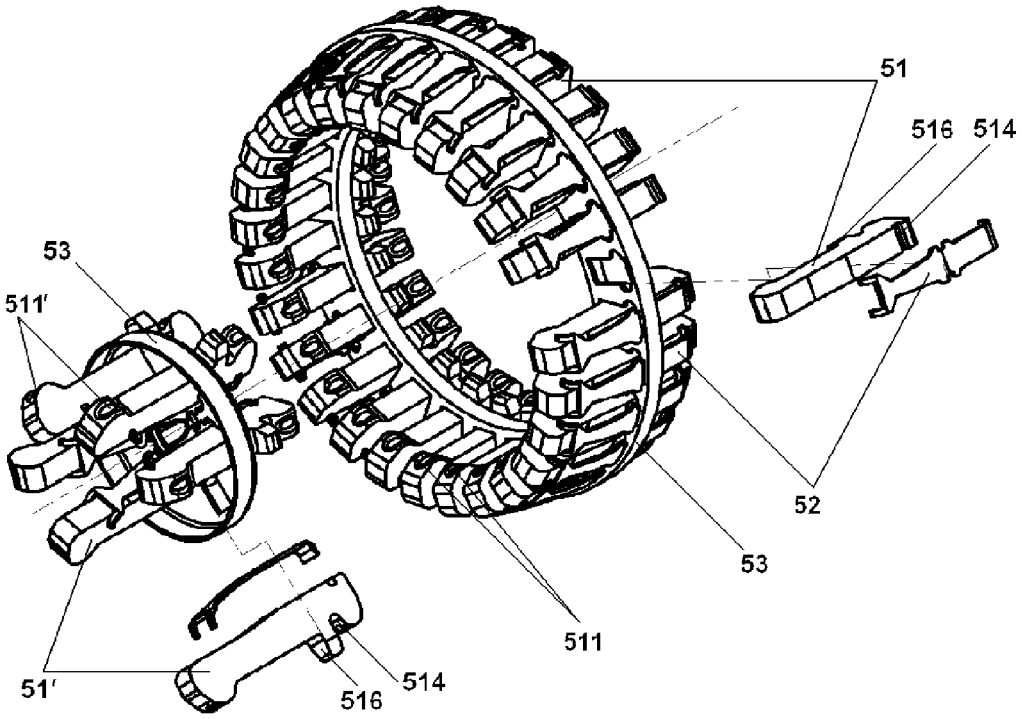
FIG. 2A is the exploded view of the tulip contact.
Figure 2B:
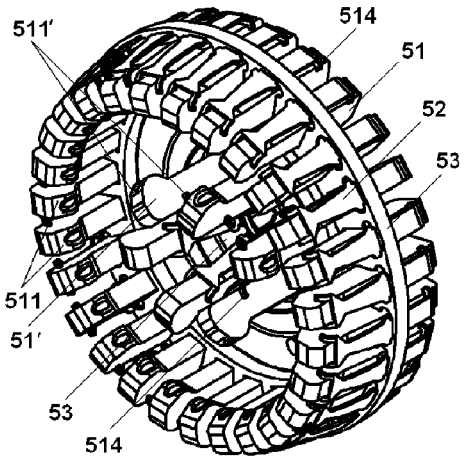
FIG. 2B is a perspective view of the tulip contact.
Figure 2C:
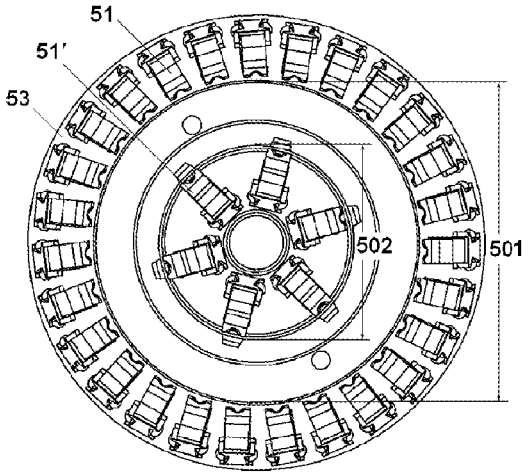
FIG. 2C is a side view of the tulip contact.
Figure 3:
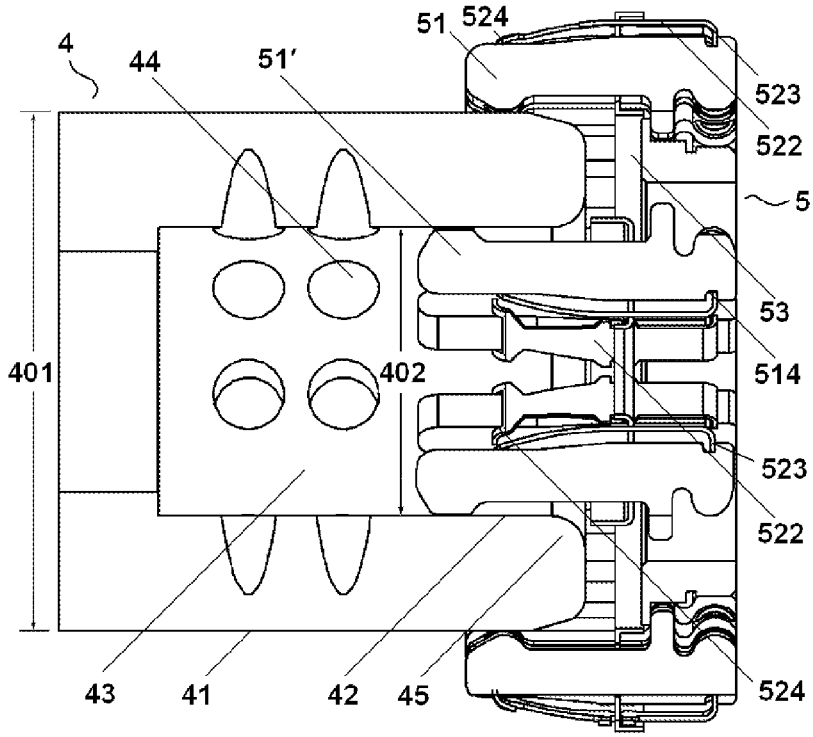
FIG. 3 is a schematic view of the tulip contact connecting with the fixed contact.

FIG. 2 shows the structure of the tulip contact according to one preferred embodiment of the present invention; in which FIG. 2A is the exploded view of the tulip contact, FIG. 2B is a perspective view of the tulip contact. The tulip contact for switching device comprises a plurality of outer contact fingers 51 and inner contact fingers 51'. Each of the contact fingers comprises a groove 514 and a holding block 516. As shown in FIG. 2 and FIG. 3, a leaf spring 522 is embedded in the grooves 514 of each of the outer contact fingers 51 and fixes the outer contact fingers 51 on a disk 53. The outer contact fingers 51 form a circular shape and are adapted to make the contact surface 511 of each of these fingers contact with the outer surface 41 of fixed contact 4. As shown in FIG. 2C and FIG. 3, the internal diameter 501 of the circle formed by the outer contact fingers 51 is a little shorter than the fixed contact's external diameter 401 in order to make the outer contact fingers 51 hold the fixed contact 4 tightly. And a leaf spring 522 is embedded in the grooves 514 of each of the inner contact fingers 51' and fixes the inner contact fingers 51' on said disk 53. The inner contact fingers 51' form a circular shape and are adapted to make the contact surface 511' of each of these fingers contact with the inner surface 42 of fixed contact 4. The external diameter 502 of the circle formed by the inner contact fingers 51' is a little longer than the fixed contact's internal diameter 402 in order to make the inner contact fingers 51' contact with the inner surface 42 of the fixed contact 4 tightly. FIG. 3 shows the tulip contact 5 connecting with the fixed contact 4.

Figure 4A:
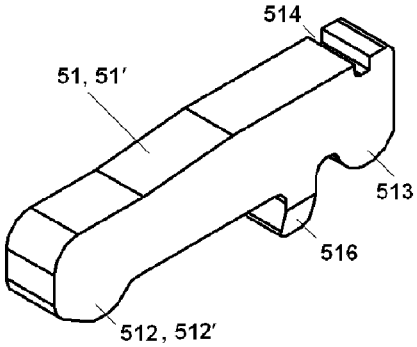
FIG. 4A is a perspective view of the contact finger.
Figure 4B:
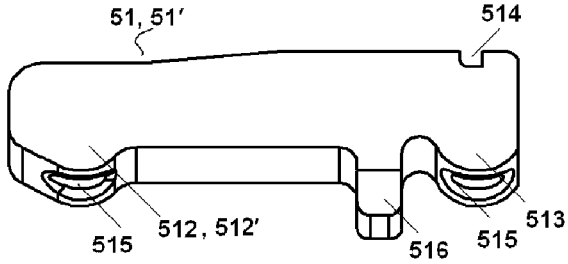
FIG. 4B shows the contact slots on the contact finger.

FIG. 4 shows the structure of a contact finger of the tulip contact 5. The outer contact fingers 51 comprise a first contact bulge 512 on the contact surface 511' for contacting with the surfaces 41 of the fixed contact 4, and a second contact bulge 513 for contacting with the bushing 6. In the same way, the inner contact fingers 51' comprise a first contact bulge 512' on the contact surface 511' for contacting with the surfaces 42 of the fixed contact 4, and a second contact bulge 513 for contacting with the bushing 6. This design enables the tulip contact 5 to hold the fixed contact 4 more tightly and to tolerate more aligning error of the tulip contact 5 and the fixed contact 4.

Figure 5A:
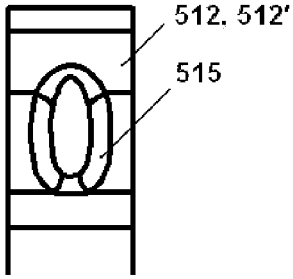
FIG. 5A shows the structure of the contact slot according to one preferred embodiment of the present invention.
Figure 5B:
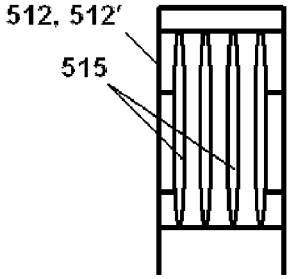
FIG. 5B shows a variation of the contact slot on the contact finger.

As shown in FIG. 4 and FIG. 5, each of the contact fingers 51, 51' comprises a contact slot 515 on the surface of the contact bulges. The contact slot 515 can increase the contact fingers' contact area with the surfaces of fixed contact 4. Thus enhances the tulip contact's 5 electric conductivity and heat elimination. FIG. 5A shows the structure of the contact slot according to one preferred embodiment of the present invention and FIG. 5B shows a variation of the contact slot on the contact finger. The contact slot 515 can be more than one slot on the contact bulges and its shape can be varied.

The contact fingers 51, 51' are made of copper or sintered alloy of copper and tungsten. These materials are high electric conductive and strong erosion resistant. To get a better conductivity, the contact fingers 51, 51' are further silver plated. The contact fingers 51, 51' are easy to assemble, disassemble and replace. The design of the contact fingers provides these contact fingers 51, 51' good contacts with the fixed contact 4 and even pressure on the fixed contact 4.

Figure 6:
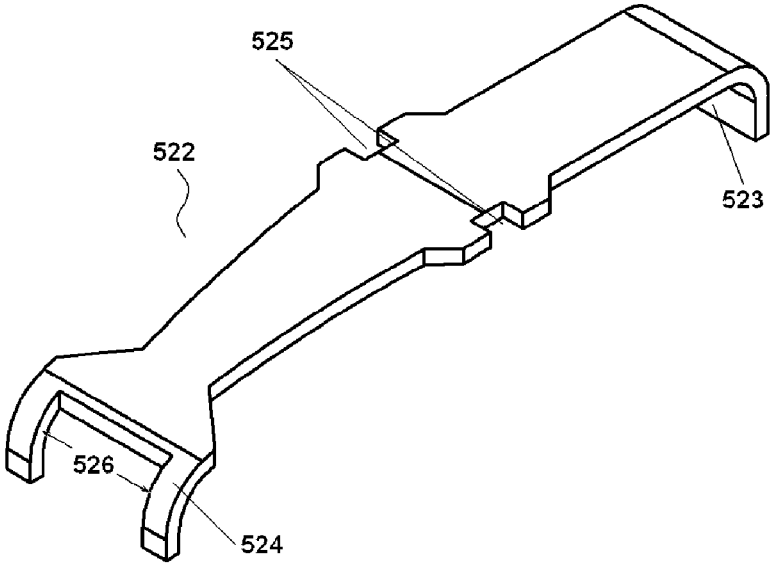
FIG. 6 is a schematic view of a leaf spring of the tulip contact.
Figure 7:
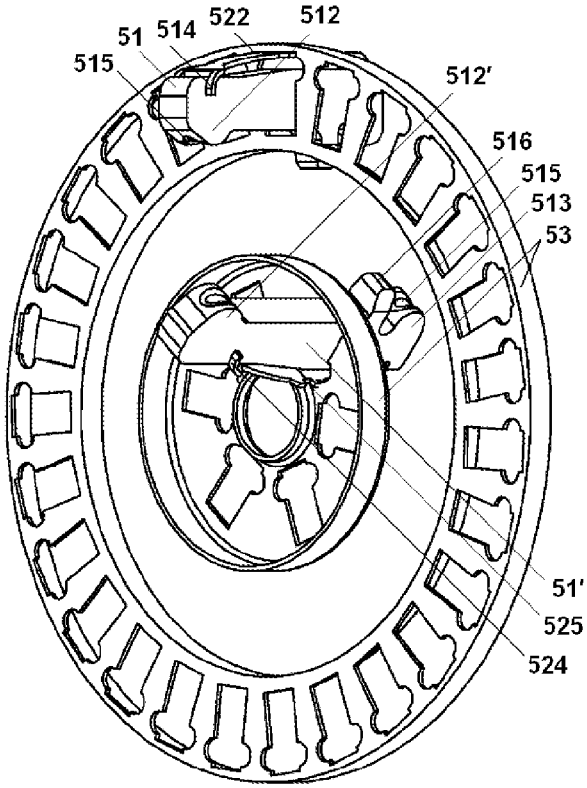
FIG. 7 is an enlargement view of a leaf spring fixing an outer contact finger on the disk and a leaf spring fixing an inner contact finger on the disk.

The structure of the leaf spring 522 is shown in FIG. 6. The leaf spring 522 is made of a high-strength stainless steel plate. It comprises a hemming 523 for embedding in the groove 514 of the contact fingers, two notches 525, and two bended legs 524 with a distance 526 between them. The distance 526 is a litter longer than the width of a contact finger. Thus, the two bended legs 524 can seize the contact finger. As shown in FIG. 7, the two notches 525 are used for fixing the contact fingers 51, 51' on the disk 53. The leaf spring 522 made of high-strength stainless steel can reduce the heat generation from eddy current. The leaf spring 522 enables the contact fingers 51, 51' to bear stress evenly and to connect with the fixed contact 4 reliably.

See FIG. 3, when the fixed contact 4 is plugged into the tulip contact 5, the outer surface of the fixed contact 4 first contacts with the inner contact fingers 51'. Since the external diameter 502 of the circle formed by the inner contact fingers 51' is a little longer than the fixed contact's internal diameter 402, the inner contact fingers 51' will be pressed inward overcoming the pressure of the leaf springs 522. In the same way, the fixed contact 4 overcomes the pressure exerted by the leaf springs 522 to prop open the outer contact fingers 51 when plugged into the tulip contact 5. After the fixed contact 4 is plugged into the tulip contact 5, the tulip contact 5 holds the fixed contact 4 tightly by the force of the leaf springs 522.

Figure 8:
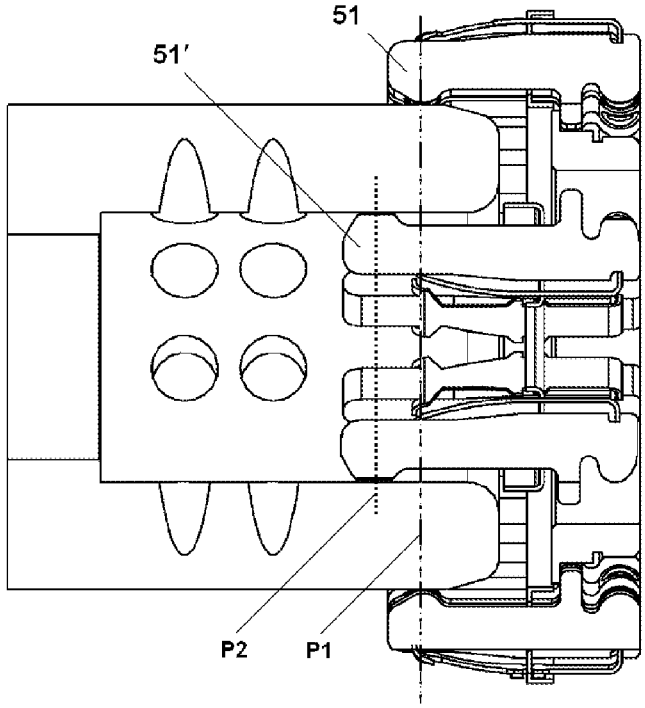
FIG. 8 shows the first contact bulges of the outer contact fingers are not at the same cross section with the first contact bulges of the inner contact fingers.

If the fixed contact 4 encounters these two kinds of resistance simultaneously, it will be difficult for the fixed contact 4 to be plugged into the tulip contact 5. Thus, as the two different dotted lines are shown in FIG. 8, according to the preferred embodiments of the invention, the imaginary plain P1 on which the plurality of first contact bulges 512 of the outer contact fingers 51 are located do not overlap with the imaginary plain P2 on which the first contact bulges 512' of the inner contact fingers 51' are located. When the fixed contact 4 is plugged into the tulip contact 5, the fixed contact 4 encounters the resistance from the inner contact fingers 51' and the outer contact fingers 51 sequentially. This design enables the fixed contact 4 easy to be plugged into the tulip contact 5.

Figure 9:
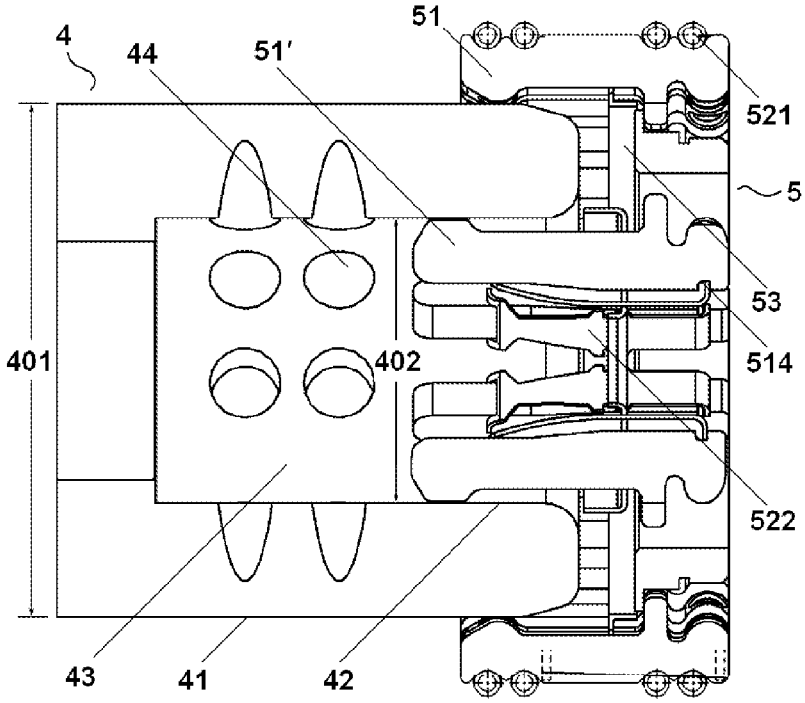
FIG. 9 shows the structure of the tulip contact, according to another preferred embodiment of the present invention, which comprises ring springs.

The tulip contact for switching device according to the second preferred embodiment, as shown in FIG. 9, comprises ring springs. Four ring springs 521 are embedded in the grooves of the outer contact fingers 51, encircles and fixes the outer contact fingers 51 on a disk 53. The outer contact fingers 51 form a circular shape and are adapted to make the contact surface 511 of each of these fingers contact with the outer surface 41 of fixed contact 4. The internal diameter 501 of the circle formed by the outer contact fingers 51 is a little shorter than the fixed contact's external diameter 401 in order to make the outer contact fingers 51 hold the fixed contact 4 tightly. In this figure, the inner contact fingers 51' are fixed on the disk 53 by leaf springs 522. The inner contact fingers 51' can also be fixed on the disk 53 by ring springs which have outward forces. The inner contact fingers 51' form a circular shape and are adapted to make the contact surface 511' of each of these fingers contact with the inner surface 42 of the fixed contact 4. The external diameter 502 of the circle formed by the inner contact fingers 51' is a little longer than the fixed contact's internal diameter 401 in order to make the inner contact fingers 51' contact with the inner surface 42 of the fixed contact 4 tightly.

Figure 10:
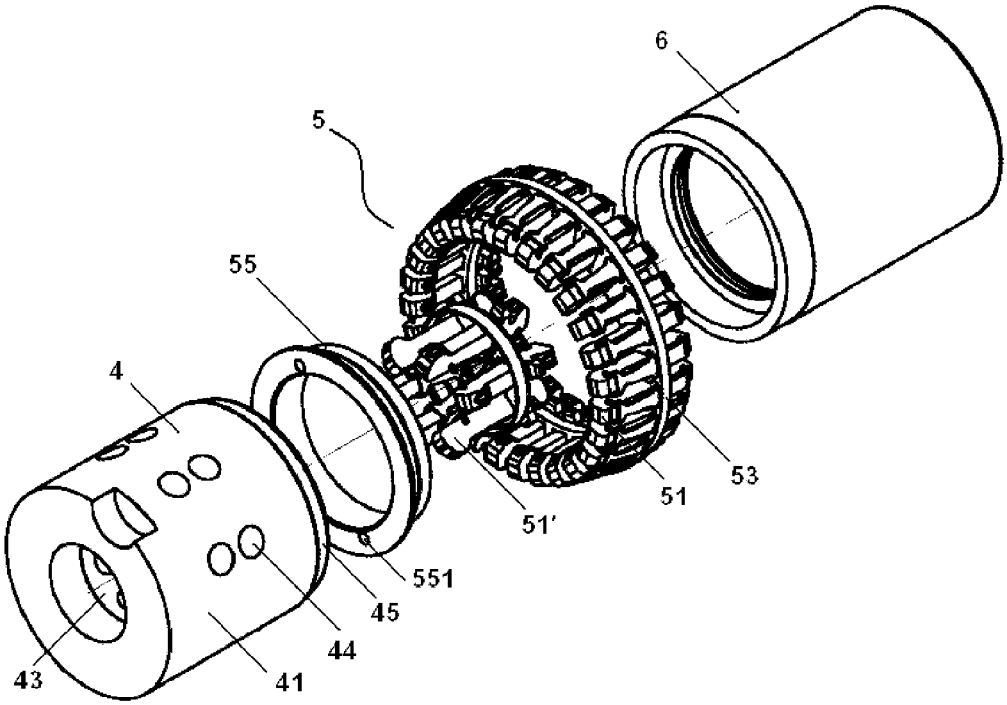
FIG. 10 shows the structure of the electrical contact system for switching device with a tulip contact according to one preferred embodiment of the present invention.
Figure 11:
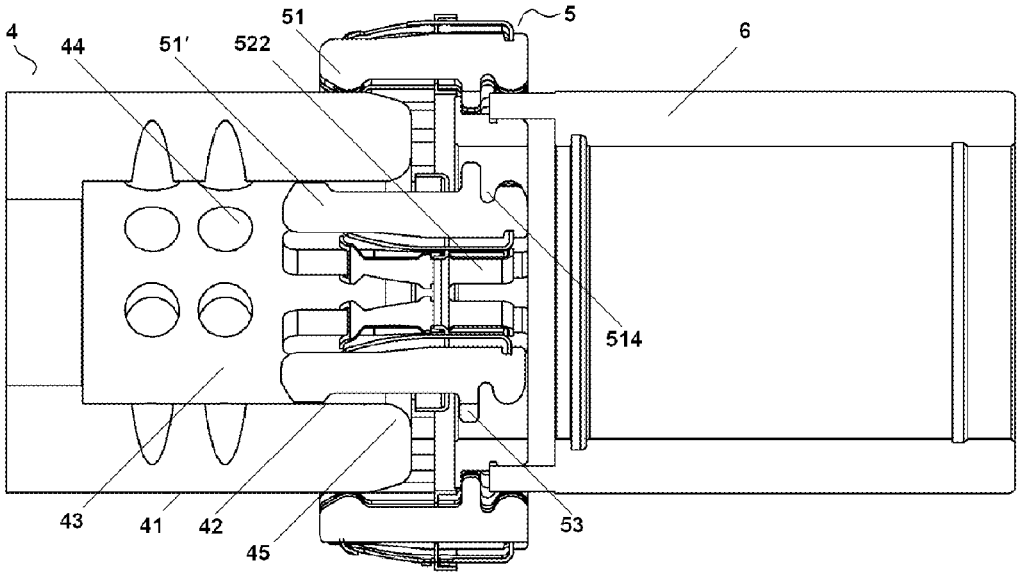
FIG. 11 is a section view of the electrical contact system.

According to another aspect of the present invention, an electrical contact system for switching device is provided. FIG. 10 and FIG. 11 show the structure of the electrical contact system for switching device with a tulip contact according to one preferred embodiment of the present invention; in which FIG. 10 is the exploded view of the electrical contact system, FIG. 11 is a section view of the electrical contact system. As shown in the figures, the electrical contact system comprises a fixed contact 4, a tulip contact 5 and a bushing 6. The tulip contact 5 has been described in details above. The fixed contact 4 has a hollow structure 43 and a plurality of openings 44 for ventilation on the cylindrical body 47. The fixed contact's external diameter 401 is a little longer than the internal diameter 501 of the circle formed by the outer contact fingers 51 in order to make the outer contact fingers 51 hold the fixed contact 4 tightly, and the fixed contact's internal diameter 401 is a little shorter than the external diameter 502 of the circle formed by the inner contact fingers 51' in order to make the inner contact fingers 51' contact with the inner surface 42 of the fixed contact 4 tightly.

The ring nut 55, as shown in FIG. 11, fixes the tulip contact 5 on one end of the bushing 6 by fastening the screws 551. The second contact bulges 513 contact with the bushing 6. The other end of the bushing 6 is connected with the switch (grounding switch, disconnector, or circuit breaker). When the tulip contact 5 is connected with the fixed contact 4, it therefore transfers high electric current on the contact surfaces. The holding block 516 prevents the bushing from being excessively plugged in and fixes the tulip contact 5 on the bushing 6 tightly.

The end of said fixed contact 4 that contacts with the tulip contact, as shown in FIG. 11, has a radial annular surface 45 which enables the fixed contact 4 easy to be plugged into the tulip contact 5. The other end of the fixed contact 4 connects copper bar in the switching device.

To enhance electric conductivity, the fixed contact 4 and the bushing 6 are also silver plated.

According to another preferred embodiment of present invention, tulip contact 5 in the electrical contact system for switching device is a preferred embodiment which uses a ring spring as described above. It will not be described in more details.

Compared with traditional contacts, the tulip contact according to the present invention can bear higher rated electric current and can provide better heat elimination. In a simulation test, compared with a tulip contact with only outer contact fingers, the electrical contact system for switching device with a tulip contact according to the present invention reduces 25% temperature raise due to good heat elimination.

Without departing from the spirit and concept of the present invention, any variations and modifications to the embodiments should be within the apprehension of those with ordinary knowledge and skills in the art, and therefore fall in the scope of the present invention which is defined by the accompanied claims. Though the present invention has been described on the basis of some preferred embodiments, those skilled in the art should appreciate that those embodiments should by no means limit the scope of the present invention. Without departing from the spirit and concept of the present invention, any variations and modifications to the embodiments should be within the apprehension of those with ordinary knowledge and skills in the art, and therefore fall in the scope of the present invention which is defined by the accompanied claims.

The invention claimed is:

1. An electrical contact system for a switching device comprising:

a fixed contact; and a tulip contact;

wherein said fixed contact has a hollow structure, said tulip contact comprises a plurality of outer contact fingers and inner contact fingers, a cross-section formed by said plurality of outer contact fingers is complimentary to a cross-section of an outer surface of a fixed contact so that a contact surface of each of the outer contact fingers contacts the outer surface of the fixed contact, a cross-section formed by said plurality of inner contact fingers is complimentary to a cross-section of an inner surface of the fixed contact so that a contact surface of each of the inner contact fingers contacts the inner surface of fixed contact, and each of said contact fingers comprises a first contact bulge for contacting with the surfaces of the fixed contact and a second contact bulge for contacting with a bushing.

2. A tulip contact for a switching device comprising:

a plurality of contact fingers, including;

outer contact fingers; and inner contact fingers;

wherein a cross-section formed by the outer contact fingers is complimentary to a cross-section of an outer surface of a fixed contact, so that a contact surface of each of the outer contact fingers contacts the outer surface of the fixed contact, a cross-section formed by the inner contact fingers is complimentary to a cross-section of an inner surface of the fixed contact so that a contact surface of each of the inner contact fingers contacts the inner surface of the fixed contact, and each of said contact fingers respectfully comprises a first contact bulge for contacting with the outer and inner surfaces of the fixed contact and a second contact bulge for contacting with a bushing.

3. The tulip contact according to claim 2, wherein each of said contact bulges comprises a contact slot on its surface.

4. The tulip contact according to claim 1, wherein each of said contact fingers comprises a groove and a holding block; the tulip contact further comprises a spring and a disk; and said spring fixes the contact fingers on said disk.

5. The tulip contact according to claim 4, wherein said spring is a leaf spring for each contact finger, one end of the leaf springs is embedded in the grooves of each of the contact fingers and, for the outer contact fingers, the other end of the leaf springs pushes the outer contact fingers on the disk axially inward; and, for the inner contact fingers, the other end of leaf springs pushes the inner contact finger on the disk axially outward.

6. The tulip contact according to claim 4, wherein said spring is a ring spring; and the ring spring is embedded in the grooves of the outer contact fingers and encircles them; and a second ring spring is embedded in the grooves of the inner contact fingers and encircles them.

7. The tulip contact according to claim 2, wherein an imaginary plain on which the plurality of first contact bulges of the outer contact fingers are located do not overlap with an imaginary plain on which the first contact bulges of the inner contact fingers are located.

8. The electrical contact system according to claim 1, further comprising: a ring nut, wherein said ring nut fixes the tulip contact on a bushing.

9. The electrical contact system according to claim 1, wherein the end of said fixed contact that contacts with the tulip contact has a radial annular surface.

10. The electrical contact system according to claim 1, wherein each of said contact bulges comprises a contact slot on its surface.

11. The electrical contact system according to claim 1, wherein each of said contact fingers comprises a groove and a holding block; the tulip contact further comprises a spring and a disk; and said spring fixes the contact fingers on said disk.

12. The electrical contact system according to claim 11, wherein said spring is a ring spring; a first ring spring is embedded in the grooves of the outer contact fingers and encircles them; and a second ring spring is embedded in the grooves of the inner contact fingers and encircles them; or said spring is a leaf spring for each contact finger, and one end of the leaf spring is embedded in the grooves of each of the contact fingers and, for the outer contact fingers, the other end of leaf springs pushes the outer contact fingers on the disk axially inward; and, for the inner contact fingers, the other end of leaf springs pushes the inner contact finger on the disk axially outward.

13. The electrical contact system according to claim 1, wherein said fixed contact comprises a plurality of openings for ventilation.

* * * * *